US006406417B1

(12) United States Patent
Fröhlich

(10) Patent No.: US 6,406,417 B1
(45) **Date of Patent: *Jun. 18, 2002**

(54) DEVICE FOR CONTINUOUSLY WINDING UP LONGITUDINALLY CUT PAPER WEBS WITH ROLLS CHANGED AUTOMATICALLY AT THE MACHINE SPEED

(75) Inventor: Helmut Fröhlich, Elchgraben (DE)

(73) Assignees: Voith Sulzer Papiertechnik Patent GmbH, Heidenheim; Voith Sulzer Finishin GmbH, Krefeld, both of (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,704

(22) PCT Filed: Mar. 13, 1997

(86) PCT No.: PCT/EP97/01271

§ 371 (c)(1),
(2), (4) Date: Jul. 15, 1998

(87) PCT Pub. No.: WO97/33821

PCT Pub. Date: Sep. 18, 1997

(30) Foreign Application Priority Data

Mar. 13, 1996 (DE) ..... 196 09 802

(51) Int. Cl.[7] ..... B31B 1/14; B65H 35/04

(52) U.S. Cl. ..... 493/363; 493/305; 493/306; 493/364; 242/525.6; 242/527; 242/527.2; 242/527.4; 242/531; 242/531.1; 242/532.2; 242/533.4; 242/533.5

(58) Field of Search ..... 493/303, 304, 493/305, 306, 363, 364, 365, 287, 403; 242/525.6, 527.4, 527.3, 527.2, 527.1, 527, 531.1, 531, 532.2, 533.4, 533.5, 533.6, 533.7, 536

(56) References Cited

U.S. PATENT DOCUMENTS 2,200,000 A 5/1940 Johnstone (List continued on next page.)

FOREIGN PATENT DOCUMENTS

DE 1091856 10/1960

(List continued on next page.)

*Primary Examiner*—Rinaldi I. Rada
*Assistant Examiner*—Christopher Harmon
(74) *Attorney, Agent, or Firm*—Greenblum & Bernstein, P.L.C.

(57) ABSTRACT

Process and device for continuously winding a plurality of longitudinally cut paper webs at machine speed by using a device that includes support rollers and at least one pair of disks associated with each of the support rollers, such that the at least one pair of disks is arranged concentrically with and rotates independently of, its associated support roller. The at least one pair of disks includes a first winding device having a first cardboard tube disposed thereon and a second winding device having a second cardboard tube disposed thereon, such that each of the support rollers include at least one of the pair of disks, which are concentrically arranged with and which rotate independently of the support rollers. The process includes axially adjusting the disks of the at least one pair of disks to correspond to a width of web to be wound, positioning the pair of disks in a first position, attaching a first end of the web onto the first cardboard tube, and running a pair of supporting rollers and the first cardboard tube up to a machine speed thereby winding the web onto the first cardboard tube. The process also includes turning the pair of disks to a second position, accelerating the second cardboard tube up to machine speed, cutting the paper web transversely to a web run direction when a desired winding diameter is achieved on the first cardboard tube thereby producing a second end, and winding the second end of the web onto the second cardboard tube. Moreover, the process includes turning the pair of disks to a third position, stopping the rotation of the first cardboard tube, removing the paper web wound onto the first cardboard tube from the first winding device, and disposing a third cardboard tube onto the first winding device.

19 Claims, 3 Drawing Sheets

U.S. PATENT DOCUMENTS

| | | | | | |
|---|---|---|---|---|---|
| 2,201,233 | A | | 5/1940 | Johnstone | |
| 3,433,429 | A | | 3/1969 | Schnitzspahn | |
| 3,599,888 | A | | 8/1971 | Coudriet et al. | |
| 4,458,853 | A | * | 7/1984 | Heymanns | 242/533 |
| 4,611,769 | A | * | 9/1986 | Orbach | 242/533.4 |
| 4,767,075 | A | * | 8/1988 | Peters et al. | 242/527.3 |
| 4,846,416 | A | * | 7/1989 | Natale | 242/533.5 |
| 5,217,177 | A | * | 6/1993 | Stefanoni | 242/533.4 |
| 5,429,320 | A | * | 7/1995 | Pack | 242/533.5 |

FOREIGN PATENT DOCUMENTS

| | | |
|---|---|---|
| DE | 1970847 | 10/1967 |
| DE | 1474243 | 12/1969 |
| DE | 7012648 | 4/1970 |
| DE | 1952205 | 5/1970 |
| DE | 1816870 | 7/1970 |
| DE | 2135434 | 1/1972 |
| DE | 8019261 | 1/1982 |
| DE | 3418741 | 11/1985 |
| DE | 3636685 | 10/1987 |
| DE | 4200478 | 4/1993 |
| DE | 9413238 | 11/1994 |
| EP | 243748 | 11/1987 |
| GB | 2080257 | 2/1982 |

* cited by examiner

DEVICE FOR CONTINUOUSLY WINDING UP LONGITUDINALLY CUT PAPER WEBS WITH ROLLS CHANGED AUTOMATICALLY AT THE MACHINE SPEED

CROSS-REFERENCE TO RELATED APPLICATIONS

The present application is a U.S. National Stage of International Application No. PCT/EP97/01271 filed Mar. 13, 1997 and claims priority under 35 U.S.C. §119 of German Patent Application No. 196 09 802.5, filed on Mar. 13, 1996.

BACKGROUND OF THE INVENTION

1. Field of the Invention

The invention concerns a device and a process for continuously winding up longitudinally cut paper webs with rolls changed automatically at machine speed.

2. Discussion of Background Information

Today, for economic reasons, paper is produced, to a great extent, continuously on production machines that are very wide. The paper webs produced that are too wide for most applications and must therefore be cut into usable sizes. So-called roll cutters are used for this.

For paper webs to be wound without axes that include longitudinally cut partial widths of a wide paper web produced on the production machine, it is not yet possible to change the finished wound-up partial-width rolls in the winding direction after the roll cutters at machine speed, if the original paper web must also be divided lengthwise or if partial-width rolls with a smaller diameter than on the original roll must be produced. For this reason, the roll cutter cannot be integrated into the continuous paper production either. As the only discontinuously working machine in every paper factory, it is arranged in a separate place and has its own output and personnel requirement.

The problem is therefore to propose a device and a process for uniform product quality that integrate the roll cutter into the continuous paper-production process with which these goals can be achieved and with which the waste and personnel requirement can be further reduced.

SUMMARY OF THE INVENTION

Therefore, a device of the type generally discussed above is provided which further includes at least two support rolls arranged downstream from, with respect to a web run direction, a longitudinal cutting device, and at least one pair of disks associated with each supporting roll and mounted for rotation independently from the associated supporting roll. The disks of the at least one pair of disks are axially positionable to accommodate a width of the web to be wound. Each pair of disks include at least two winding devices that are radially positionable, and each winding device has a core drive adapted to receive winding tube. At least one cutting device arranged to cut the web laterally to the web run direction and adapted to start the winding of a new winding roll.

The process for continuously winding longitudinally cut paper webs with the rollers changed automatically at machine speed by a device according to the present invention is characterized by a fact that the first winding device of the pair of disks involved in the winding process has a cardboard tube mounted on it, that the starts of the paper webs cut to the width are attached to or wound on the cardboard tubes that the supporting rollers and the cardboard tubes are run up to machine speed that the disks are turned to the next position during the winding process that every second winding device has a cardboard tube that the cardboard tubes are accelerated to machine speed that when the desired winding diameter is reached, the paper web is cut crosswise to the conveyor direction and the start of the new web is wound on the second cardboard tube that the pair of disks is turned to the next position during the winding process; and that the wound-up paper web is stopped, taken out of the first winding device and a new cardboard tube is put on.

BRIEF DESCRIPTION OF THE DRAWINGS

Other details will be explained in greater detail using the examples of embodiment shown in FIGS. 1 to 3.

DETAILED DESCRIPTION OF THE PRESENT INVENTION

Figure 1:
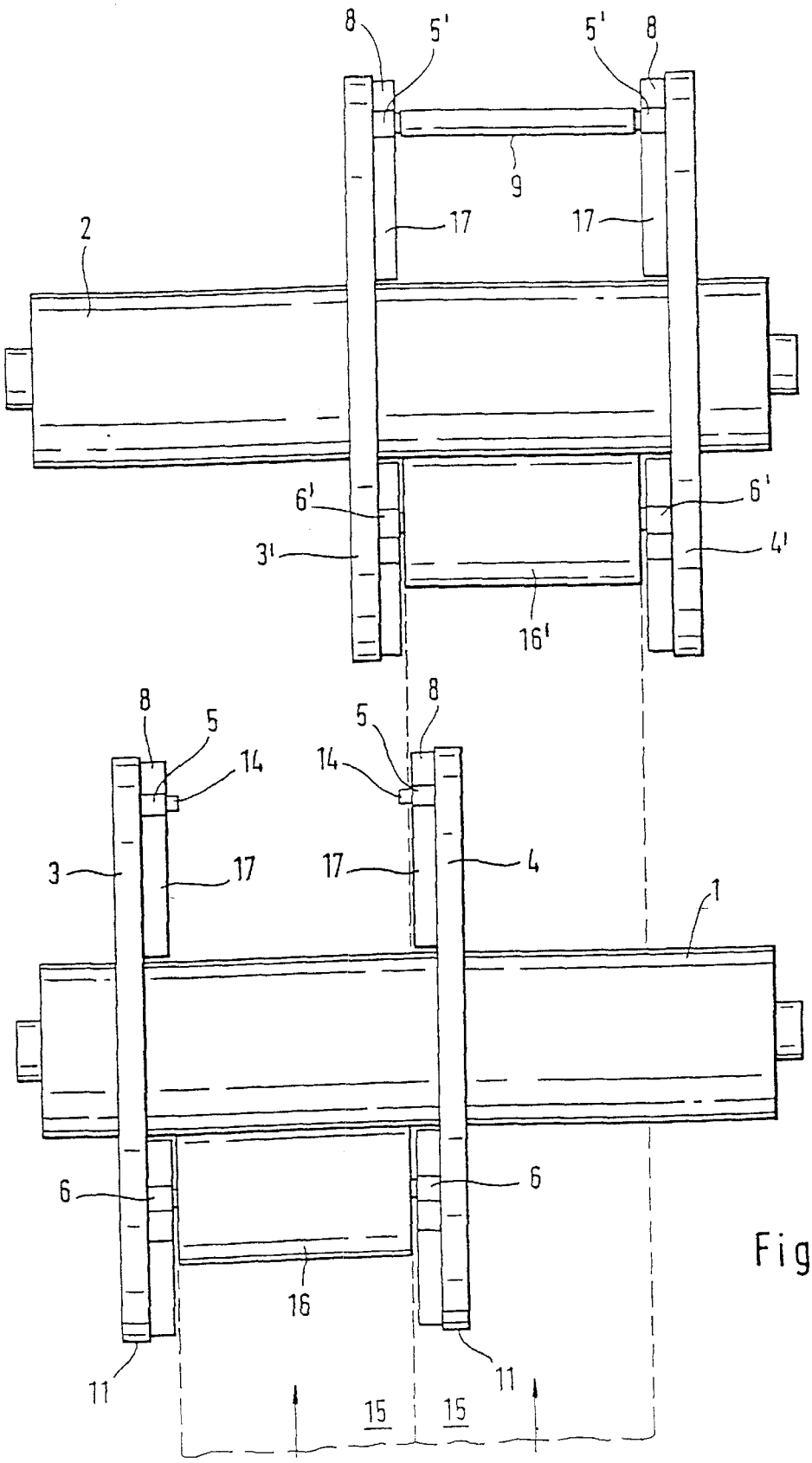
FIG. 1 shows a top view of a first embodiment of the invention with two winding devices per pair of disks.

The example of embodiment in FIG. 1 has two supporting rollers 1, 2 arranged one after the other in the direction in which the paper web 15 is moving. They are aligned to one another in a machine frame in the usual way and mounted so they can turn. Details on the mounting and drive mechanisms of the supporting rollers are not shown to allow the features of the invention to stand out more clearly. Each supporting roller (support roll) has a pair of disks 3, 4 or 3', 4', which is mounted concentrically to the supporting rollers 1, 2 and can turn independently of them and whose axial distance can be adjusted to the width of the paper webs 15 to be wound up. In the example shown, an original paper web the width of the paper-production machine is shown on a roll cutter, not shown, in two paper webs the same width 15 cut longitudinally, where the left paper web is wound up by the first winding device 5, 6, seen in the conveyor direction, and the right on the second winding device 5, 6. The drive mechanism and the mounts for the pair of disks 3, 4 and 3', 4' are not shown for the reasons already given.

The embodiment is also simplified in that the whole system is designed for only two paper webs 15. Naturally, the supporting rollers 1, 2 can be designed to be longer, and two or more pairs of disks 3, 4, 3', 4' can be arranged per supporting roller 1, 2, if the original paper web is wider than shown or is to be cut into more than two paper webs. If that case, the pair of disks is arranged staggered crosswise to the paper web so that the winding devices work together with one supporting roller 1 for the first, third, fifth, etc. paper webs, and the winding devices for the second, fourth, sixth, etc. paper webs with the other supporting roller 2.

Should relatively narrow paper webs be wound, the width for the pair of disks and the winding device may not be sufficient. In that case, the embodiment shown can be changed so that more than two supporting rollers are provided and paper webs 1, 4, 7 are assigned to the first supporting roller, paper webs 2, 5, 8 to a second and paper webs 3, 6, 9 to a third.

In the example of embodiment shown in FIG. 1, there are two winding devices 5, 6 and 5', 6' arranged staggered 180 degrees to one another per pair of disks 3, 4, 3', 4'. They are each mounted in a left and right guide, so that it is possible to adjust them radially, for which known pneumatic, hydraulic or electric-motor drives can be used. The diameter of the pair of disks 3, 4, 3', 4' here is chosen so that the largest possible diameter of a wound paper web 16 is always within the outer circumference 11, so that the pair of disks 3, 4, 3', 4' can be swiveled by on the machine frame necessary to mount it. Only in the removal position can the wound-up paper webs 16 be adjusted radially further to the outside.

On the top part of the drawing, the winding device 5 is shown with a cardboard tube 9 on it, while on the bottom part, the thorn 14 of the winding device 5 can be seen. The lower winding devices 6' hold a finished wound paper web 16. The edges of the paper webs 15 that go under the device in the invention are shown in dashes.

Figure 2:
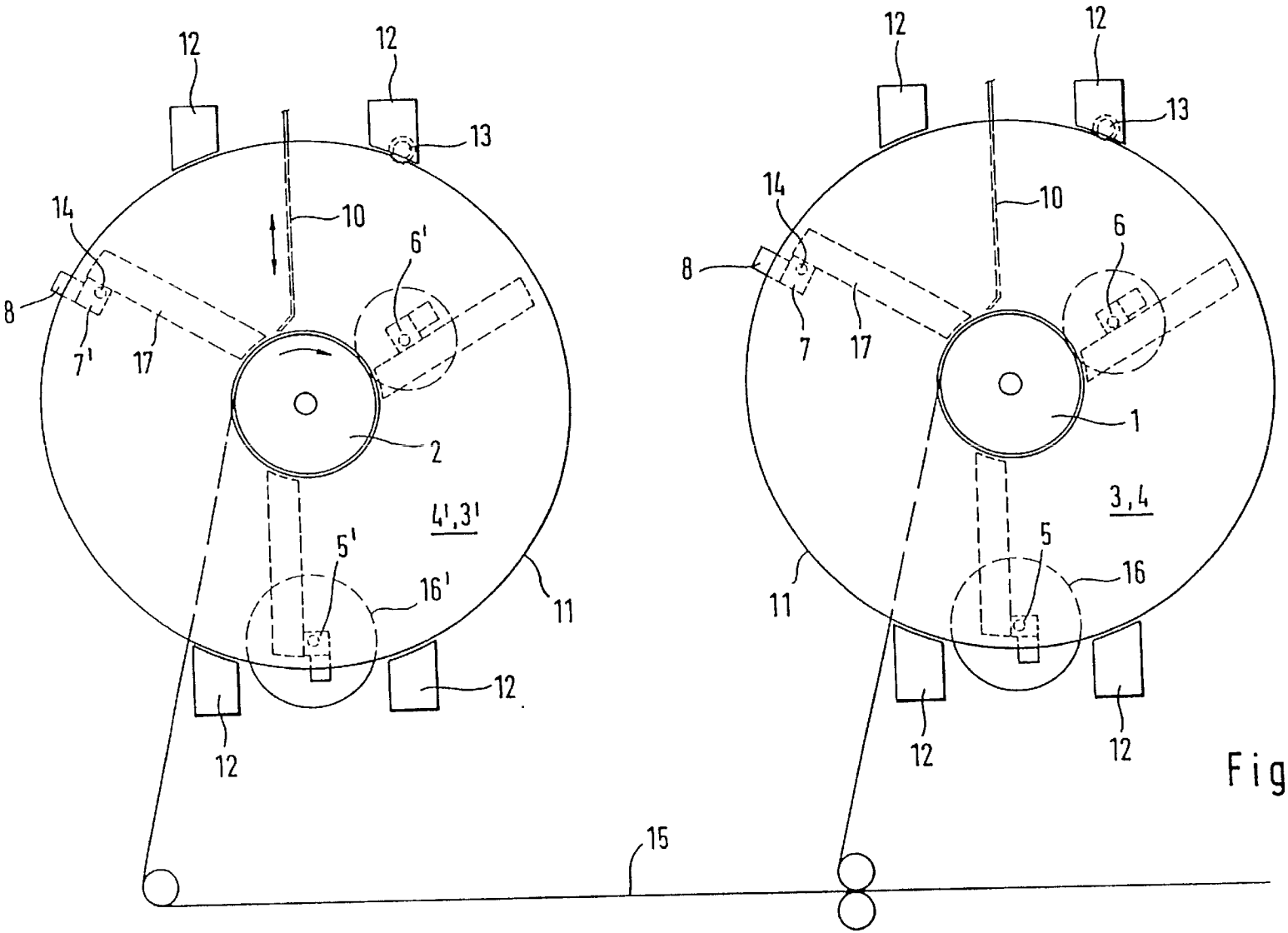
FIG. 2 shows a side view of a second embodiment of the invention with three winding devices per pair of disks and FIG. 3 shows a detail of the winding device.

FIG. 2 shows an embodiment of the invention with two supporting rollers 1 and 2 and two pairs of disks 3, 4, 3', 4', where unlike FIG. 1, there are three winding devices 5, 6, 7 with core drives 8. This device has three different working positions, but otherwise is not different from the example in FIG. 1.

The machine frame 12 with the drive 13 for the pair of disks 3, 4, 3', 4' is also shown, and the machine frame 12 is also used to mount the supporting rollers 1 and 2; it has devices, not shown, in which the distance between the disks 3,4 and 3', 4' can be adjusted to the desired width of the paper webs 15 to be wound. Details of the mounting and adjustment devices are not shown.

A device 10 known in and of itself for cutting a paper web 15 to a width crosswise to the conveyor direction and for winding the new start of the web on a cardboard tube 9 accelerated to machine speed is also shown. The device 10 can run radially in and out between the pair of disks 3, 4, 3', 4'. It works in the known way with a burst of compressed air, which cuts the paper web and blows the start of the new web against the empty cardboard tube 9, which is coated with an adhesive for the purpose, so that the winding process can go on with no problems.

A finished wound paper roll 16 is conveniently taken out below in the position shown between two guides on the machine frame 12 extending parallel to the supporting roller axis for the pair of disks, and the wound paper web 16 can move further to the outside radially than while winding and pivoting the pair of disks 3, 4, 3', 4' when the working positions are changed.

Figure 3:
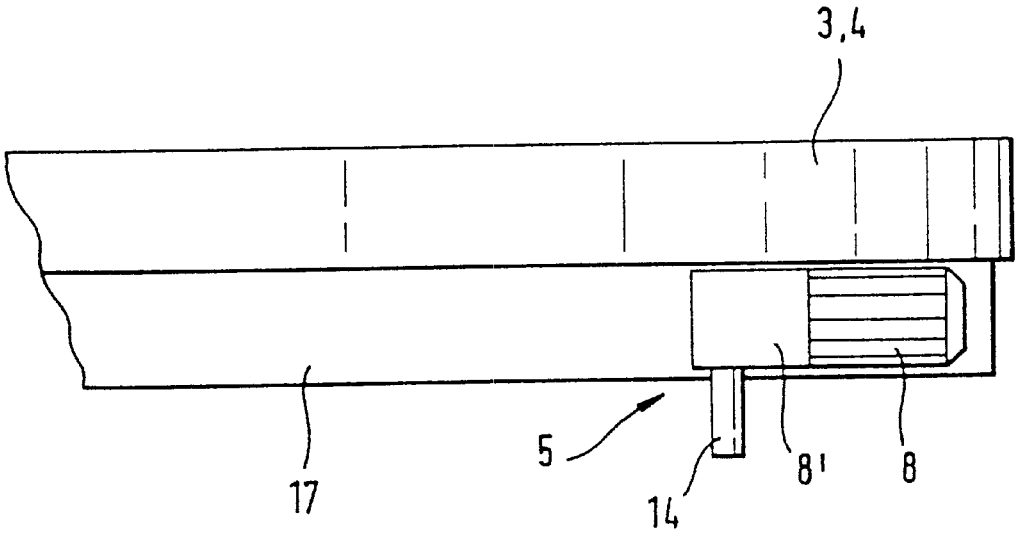

FIG. 3 shows an enlarged cutout from FIGS. 1 and 2. Each disk 3, 4 has a radially arranged guide 17 for the winding device 5 including a core drive 8, angular gear 8' and thorn 14, which can be driven by a drive, not shown, which can be pneumatic, hydraulic or an electric motor, on one hand, radially against the supporting roller and can be moved radially to the outside, on the other, to remove a finished paper roll 16 or to put on a new cardboard tube 9. Designs known to the expert can be used for this, without having to make other embodiments.

The device in the invention is used by putting a cardboard tube 9 on each first winding device 5, 5' of the pair of disks 3, 4, 3', 4' involved in the winding process, attaching or winding the start of the paper web 15 cut to the width on the cardboard tubes 9 and then running up the supporting rollers 1,2 and the cardboard tubes 9 to machine speed by the accompanying drives. On a roller cutter not integrated into the paper-production process, in which the advantages of the invention can be properly used, that speed is the web speed in the paper production.

While the paper webs 15 are wound on the first cardboard tubes 9, the pair of disks 3, 4, 3', 4' keep turning into the next position, i.e., in the embodiment in FIG. 1, 180 degrees, and in the embodiment in FIG. 2, 120 degrees. In this position, the cardboard tubes 9 are put on the next winding devices 6, 6'. This is also the position in FIG. 1 in which the finished wound paper webs 16 are taken out of the device.

In FIG. 2, there is still a third winding device 7 and hence a third working position, so that a third cardboard tube 9 can be put on and the first finished paper roll can be taken off, while the second roll is still being wound. Thus organizational advantages and convenient correction of the work cycles are connected.

If the planned roll diameter is reached, the paper web 15 is cut crosswise to the conveyor direction and the start of a new web is wound on the next cardboard tube 9, which was of course accelerated to machine speed ahead of time. In the last position, the finished wound paper webs 16 are cut and taken out off the winding device, so that it is free for a new cardboard tube 9.

Arranging two or more winding devices in one pair of disks mounted coaxially to the supporting rollers makes it possible to operate the roll cutter continuously, because paper webs 15 cut to widths of any length can be wound without having to interrupt the winding process. New cardboard tubes can be inserted according to the revolver principle, accelerated and put in a position in which they can start a new web moved at machine speed. Thus, it has become possible to integrate the roll cutter in the largely automated paper-production process. So cutting to predetermined web widths need not be done in lots, with the roll cutter stopping and starting several times; this reduces not only the waste, but also the need for personnel. Thus, it is possible to produce paper webs of any width and length directly connected to the wide, continuously working paper-production machines, i.e. paper webs can be produced in all desired widths and lengths from the original paper web produced practically endlessly and very wide for economic reasons, without intermediate winding being necessary and without a separate roll cutter that can only work in lots and is outside the actual production line. The roll cutter can instead be fully integrated into the paper production.

What is claimed is:

1. A process for continuously winding a plurality of longitudinally cut paper webs at machine speed by using support rollers and at least one pair of disks associated with each of the support rollers, such that the at least one pair of disks is arranged concentrically with and rotates independently of, its associated support roller, the at least one pair of disks including a first winding device having a first cardboard tube disposed thereon and a second winding device having a second cardboard tube disposed thereon, such that each of the support rollers include at least one of the pair of disks, which are concentrically arranged with and which rotate independently of the support rollers, the process comprising:

axially adjusting the disks of the at least one pair of disks to correspond to a width of web to be wound;

positioning the pair of disks in a first position;

attaching a first end of the web onto the first cardboard tube;

running the supporting rollers and the first cardboard tube up to a machine speed thereby winding the web onto the first cardboard tube, wherein the first cardboard tube is driven by a first core winding device;

turning the pair of disks around an axis of the associated support roller to a second position;

accelerating the second cardboard tube up to machine speed with a second core winding device;

cutting the paper web transversely to a web run direction when a desired winding diameter is achieved on the first cardboard tube thereby producing a second end;

winding the second end of the web onto the second cardboard tube;

turning the pair of disks around an axis of the associated support roller to a third position;

stopping the rotation of the first cardboard tube;

removing the paper web wound onto the first cardboard tube from the first winding device; and disposing a third cardboard tube onto the first winding device.

2. The process of claim 1, wherein the pair of disks further includes a third winding device having a fourth cardboard tube disposed thereon, and the first, second and third winding devices are provided for each of the pair of disks, the process further comprises turning the pair of disks in a first, second and third position which are staggered 120° to one another, wherein the first position is used to put on the fourth cardboard tube, the second position being used for winding the paper webs and the third position for stopping and taking out the wound paper web.

3. The process of claim 1, wherein, for each of the supporting rolls, the process further comprises simultaneously changing the position change of the pair of disks and winding on the third cardboard tube.

4. A device for continuously winding webs comprising:

a longitudinal cutting device positioned to cut a web into a plurality of webs;

at least two support rolls positioned downstream from, relative to a web run direction, said longitudinal cutting device;

at least one pair of disks being associated with each support roll and mounted concentrically with, and for rotation independently from, the associated supporting roll;

the disks of said at least one pair of disks being axially positionable to accommodate a width of the web to be wound;

at least two winding devices, associated with said at least one pair of disks, that are radially positionable, and each of said at least two winding devices comprising a core drive adapted to receive winding tube and to drive the received winding tube to a machine speed; and at least one cutting device arranged to cut the web laterally to the web run direction and adapted to wind a leading end of the laterally cut web onto a new winding roll, wherein a winding tube for the new winding roll is accelerated to a machine speed before the paper web is attached to the new winding tube.

5. The device in accordance with claim 4, wherein said at least two winding devices comprising three winding devices.

6. The device in accordance with claim 4, wherein said support rolls are arranged at a same height and such that one of the support rolls is arranged further downstream from the longitudinal cutting device than the other support roll, and said at least one pair of disks associated with each of said support rolls being positionally staggered across a length of said support rolls.

7. The device in accordance with claim 4, said axial distances between the at least one pair of disks associated with each of said support rolls corresponding to a width of the uncut web, wherein said at least one pair of disks are arranged so that adjacent ones of the plurality of webs are wound between corresponding at least one pairs of disks associated with different support rolls.

8. The device in accordance with claim 4, said at least one cutting device comprising a cutting device associated with each support roll.

9. The device in accordance with claim 4, said at least one cutting device comprising a cutting device associated with each pair of disks.

10. The device in accordance with claim 4, further comprising one of a torque and tension-controlled drive.

11. The device in accordance with claim 4, wherein said disks of said at least one pair of disks have an outer circumference arranged to be rotatably mounted and to rotatably drive the disks.

12. The device in accordance with claim 11, further comprising a machine frame for rotatably mounting said disks of said at least one pair of disks and for rotatably mounting said support rolls.

13. The device in accordance with claim 11, further comprising a drive device associated with each said at least one pair of disks to rotatably drive said disks of said at least one pair of disks, whereby said winding devices are positionable into specific positions.

14. The device in accordance with claim 4, wherein said winding devices are pressable against said associated support roll and radially displaceable inwardly.

15. The device in accordance with claim 4, wherein said winding device comprising thorns adapted to receive said winding tubes.

16. A process for continuously winding a plurality of webs in an apparatus that includes a longitudinal cutting device, at least two support rolls positioned downstream from, relative to a web run direction, the longitudinal cutting device, at least one pair of disks associated with each support roll and mounted concentrically with, and for rotation independently from, the associated supporting roll, the disks of the at least one pair of disks are axially positionable, at least two winding devices, associated with the at least one pair of disks, that are radially positionable, each of the at least two winding devices include a core drive adapted to receive and drive a winding tube, and at least one cutting device, the process comprising:

axially adjusting the disks of the at least one pair of disks to correspond to a width of web to be wound;

longitudinally cutting the web into a plurality of webs;

positioning a winding tube in at least one of the winding devices in each of the at least one pair of disks;

rotating the winding tubes and support rolls at a machine speed, wherein the winding tubes are driven by the core drive of the winding device;

winding the plurality of webs onto the rotating winding tubes to form wound rolls;

positioning another winding tube in another of the winding devices in each of the at least one pair of disks;

rotating the another winding tubes to a machine speed via the core drive of the another winding device;

rotating the at least one pair of disks around the associated support rolls to a next winding position;

cutting the webs winding onto the wound rolls laterally to a web run direction; and winding a leading edge of the cut web onto the another winding tubes.

17. The process in accordance with claim 16, further comprising:

removing a finished wound roll while a next wound roll is being formed; and positioning a next winding tube in the position of the removed finished wound roll.

18. The process in accordance with claim 16, wherein the at least two winding devices includes three winding devices which are spaced apart about 120° around the pair of disks, and the process further comprises:

rotating the pair of disks into three winding positions, in which a first winding position is provided for inserting the next winding tube, a second winding position is provided for winding the wound roll; and a third winding position is provided for the removing of the finished wound roll.

19. The process in accordance with claim 16, further comprising:

simultaneously rotating all of the pairs of disks around their associated support rolls; and simultaneously beginning the winding of the next rolls in all of the pairs of disks.

* * * * *

UNITED STATES PATENT AND TRADEMARK OFFICE

CERTIFICATE OF CORRECTION

PATENT NO. : 6,406,417 B1
DATED : June 18, 2002
INVENTOR(S) : Helmut Frohlich

It is certified that error appears in the above-identified patent and that said Letters Patent is hereby corrected as shown below:

Title page,
Item [73], Assignees, should read as follows:
-- Voith Sulzer Papiertechnik Patent GmbH of Heidenheim (DE). --

Signed and Sealed this

Twenty-ninth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,406,417 B1
DATED : June 18, 2002
INVENTOR(S) : Fröhlich

It is certified that error appears in the above-identified patent and that said Letters Patent is hereby corrected as shown below:

Title page,
Item [*] Notice, delete "0" and insert -- 416 --.

Signed and Sealed this

Eighth Day of July, 2003

JAMES E. ROGAN
*Director of the United States Patent and Trademark Office*